US011668192B2

(12) United States Patent
Weiser

(10) Patent No.: US 11,668,192 B2
(45) Date of Patent: Jun. 6, 2023

(54) TUNNEL BORING MACHINE AND TUNNELLING METHOD

(71) Applicant: HERRENKNECHT AKTIENGESELLSCHAFT, Schwanau (DE)

(72) Inventor: Torsten Weiser, Seelbach (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 0 days.

(21) Appl. No.: 17/052,556

(22) PCT Filed: Jun. 5, 2019

(86) PCT No.: PCT/EP2019/064732
§ 371 (c)(1),
(2) Date: Nov. 3, 2020

(87) PCT Pub. No.: WO2019/234131
PCT Pub. Date: Dec. 12, 2019

(65) Prior Publication Data

US 2021/0180452 A1 Jun. 17, 2021

(30) Foreign Application Priority Data

Jun. 8, 2018 (DE) ..... 10 2018 113 788.5

(51) Int. Cl.
*E21D 9/11* (2006.01)
*E21D 9/00* (2006.01)
(Continued)

(52) U.S. Cl.
CPC ..... *E21D 9/112* (2013.01); *E21D 9/003* (2013.01); *E21C 35/24* (2013.01); *E21C 39/00* (2013.01); *E21D 9/108* (2013.01)

(58) Field of Classification Search
CPC ..... E21D 9/087; E21D 9/10; E21D 9/1006; E21D 9/104; E21D 9/11; E21D 9/112;
(Continued)

(56) References Cited

U.S. PATENT DOCUMENTS 8,719,118 B2 5/2014 Hacker
9,181,800 B2 11/2015 Edelmann et al.
(Continued)

FOREIGN PATENT DOCUMENTS

DE 102007005560 B4 12/2009
DE 102011114830 B3 3/2013
(Continued)

OTHER PUBLICATIONS

F Kbppl et al: "Cutting tool wear prognosis and management of wear-related risks for Mix-Shield TBM in soft ground", Proceedings of the 18th International Conference on Soil Mechanics and Geotechnical Engineering, Paris, Sep. 2-6, 2013, y Sep. 6, 2013 (Sep. 6, 2013), pp. 1739-1742.
(Continued)

*Primary Examiner* — Janine M Kreck
*Assistant Examiner* — Michael A Goodwin
(74) *Attorney, Agent, or Firm* — Faegre Drinker Biddle & Reath LLP

(57) ABSTRACT

A tunnel boring machine having a cutting wheel equipped with a number of excavation tools provided with sensor units and, in a corresponding tunnelling method, only substantially fully worn excavation tools are able to be replaced using a data processing device designed with an advancement planning unit by detecting the current state of the excavation tools and predicting the state of the excavation tools on tool replacement predication planes lying in the advancing direction.

12 Claims, 6 Drawing Sheets

(51) Int. Cl.

| | |
|---|---|
| *E21C 39/00* | (2006.01) |
| *E21C 35/24* | (2006.01) |
| *E21D 9/10* | (2006.01) |

(58) Field of Classification Search
CPC ..... E21D 9/003; E21D 9/108; E21C 35/24; E21C 39/00
See application file for complete search history.

(56) References Cited

U.S. PATENT DOCUMENTS

| | | | | |
|---|---|---|---|---|
| 10,519,771 | B2 * | 12/2019 | Li | E21D 9/108 |
| 2009/0297273 | A1 * | 12/2009 | Lindbergh | E21D 9/003 405/138 |
| 2014/0231142 | A1 * | 8/2014 | Poitzsch | E21B 47/07 175/50 |
| 2014/0232167 | A1 * | 8/2014 | Edelmann | E21D 9/112 299/1.3 |
| 2015/0149027 | A1 * | 5/2015 | Paulsen | E01C 23/127 701/29.4 |
| 2019/0112924 | A1 * | 4/2019 | Kawai | E21D 9/104 |

FOREIGN PATENT DOCUMENTS

| | | | |
|---|---|---|---|
| EP | 2578797 | A1 | 4/2013 |
| JP | H10140981 | A | 5/1998 |

OTHER PUBLICATIONS

International Search Report and Written Opinion received for PCT Patent Application No. PCT/EP2019/064732, dated Sep. 12, 2019, 14 pages. (3 pages of English Translation and 11 pages of Original Document).

Yao-Tung Leng: "Review of Cutter Wear-Consumption and Specification Used in the Hsueshan Tunnel TBM Excavation", 2005 World Long Tunnels, Nov. 10, 2005 (Nov. 10, 2005), pp. 347-354.

Scheffer, Markus et al., "Simulation of Maintenance Strategies in Mechanized Tunneling," IEEE, Proceedings of the 2016 Winter Simulation Conference, (2016) pp. 3345-3356.

* cited by examiner

TUNNEL BORING MACHINE AND TUNNELLING METHOD

CROSS-REFERENCE TO RELATED APPLICATION

This application is a U.S. National Phase Patent Application based on International Application Serial No. PCT/EP2019/064732, filed Jun. 5, 2019, the entire disclosure of which is hereby explicitly incorporated by reference herein.

FIELD

The present disclosure relates to a tunnel boring machine. Furthermore, the disclosure relates to a tunnelling method.

BACKGROUND

One known tunnel boring machine is disclosed in DE 10 2011 114 830 B3. This tunnel boring machine has a rotatable cutting wheel and comprises a number of excavation tools equipped with cutting rollers, which excavation tools are arranged on the cutting wheel at specific excavation tool positions. In addition, a number of sensor units are provided, wherein a sensor unit is always assigned to an excavation tool and is designed to detect the status of the relevant excavation tool in the form of associated excavation tool data. In addition, a data processing device is provided, which is connected to the sensor units, in order to display the rotational states of the cutting rollers on the screen.

A method for managing drilling rods, drilling tools, borehole piping and the like for earth boreholes is known from EP 2 578 797 A1, in which an electronic data processing system stores information about the inventory and the current storage location of parts to be inserted into a borehole along with information about the installation position and/or installation sequence of all parts inserted into the borehole. This allows efficient control of an automatic storage, conveyance and re-storage device to be controlled efficiently.

A method for detecting the wear of cutting rollers for excavation tools of a tunnel boring machine is known from JPH10140981A in order to achieve a relatively high operational reliability of the tunnel boring machine.

SUMMARY

The present disclosure provides a tunnel boring machine and a tunnelling method, which are characterized by a sufficiently reliable compliance with tool replacement intervals that are designed for a maximum wear of excavation tools even in the case of changing geology.

A relatively high level of reliability is produced with relatively favorable operating costs due to the fact that, with the tunnel boring machine according to the invention and with the tunnelling method for determining the status of excavation tools, specifically the operating status, characterized for example by a temperature or, in the case of excavation tools equipped with cutting rollers, by the rotational state of the cutting rollers, and/or by the wear status, characterized for example by a remaining residual thickness of an excavation tool, excavation tool data are detected excavation-tool-specifically and are processed, together with geospatial data of the to-be-cut-through tunnelling route, by means of an advancement planning unit to the effect that, with the specified advancement parameters, tool replacement predication planes are reached with either excavation tools that are extensively or preferably at least to some extent fully worn at a tool replacement predication plane and therefore must be replaced, or with only partially worn, but still serviceable, excavation tools after changing the excavation tool position to reach the next tool replacement predication plane.

In one form thereof, the present disclosure provides a tunnel boring machine with a rotatable cutting wheel, with a number of excavation tools, which are mounted at specific excavation tool positions on the cutting wheel, with a number of sensor units, wherein a sensor unit is always assigned to an excavation tool and is designed to detect the status of the relevant excavation tool in the form of associated excavation tool data, and with a data processing device, which is connected to the sensor units, characterized in that for every sensor unit, an excavation tool data storage area is provided, in which the excavation tool data associated with a specific excavation tool can be stored from the sensor unit assigned to the relevant excavation tool, that the data processing device comprises a geospatial data storage, in which geospatial data that are characteristic for the geology to be broken through can be stored for a tunnelling route to be cut through in an advancing direction, that the data processing device comprises an advancement planning unit, with which, based on the geospatial data and the excavation tool data advancement parameters as well as the excavation tool positions of excavation tools, it is possible to make a determination between tool replacement predication planes located in the advancing direction in such a way that at the tool replacement predication planes for excavation tools that reach the next tool replacement predication plane in a functional state only at a different excavation tool position, a position change takes place at the or a different excavation tool position, and for excavation tools that reach the next tool replacement predication plane in a functional state no longer at an excavation tool position, a replacement with a new to-be-installed excavation tool takes place.

In another form thereof, the presend disclsoure provides a method for tunnelling having the following steps: making available a tunnel boring machine according to the preceding paragraph, storing in the geospatial data storage geospatial data that are characteristic for the geology to be broken through for the tunnelling route to be cut through in an advancing direction, based on the geospatial data and on excavation tool data, determining advancement parameters and excavation tool positions of excavation tools between tool replacement predication planes located in the advancing direction with the advancement planning unit in such a way that at the tool replacement predication planes for excavation tools that reach the next tool replacement predication plane in a functional state only at a different excavation tool position, a position change takes place at the or a different excavation tool position, and for excavation tools that reach the next tool replacement predication plane in a functional state no longer at an excavation tool position, a replacement with a new to-be-installed excavation tool takes place.

DESCRIPTION OF THE DRAWINGS

Further expedient embodiments and advantages of the invention are yielded from the following description of exemplary embodiments of the invention making reference to the figures in the drawing.

They show.

DETAILED DESCRIPTION

Figure 1:
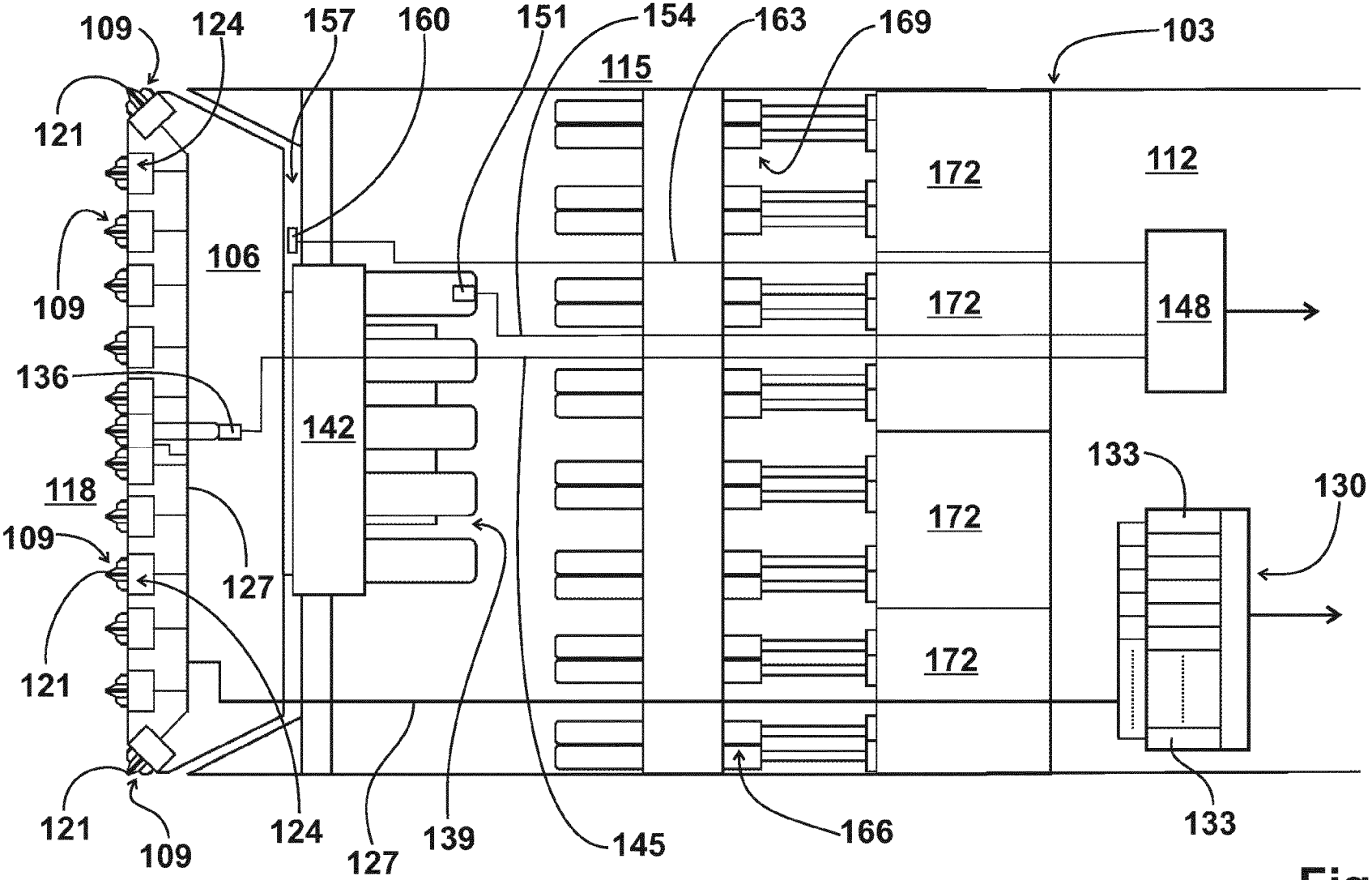
FIG. 1 A side view in a simplified representation of an exemplary embodiment of a tunnel boring machine according to the invention, FIG. 2 As an example, a sectional view of an excavation tool embodied with a cutting roller for a tunnel boring machine according to the invention, in which a sensor unit comprises a load detection module, FIG. 3 A top view of the excavation tool according to FIG. 2 with a wear status detection module of the sensor unit, FIG. 4 As an example, a perspective view of an excavation tool embodied with a cutting roller for a tunnel boring machine according to the invention, in which a sensor unit is embodied with a rotational state detection module, FIG. 5 As an example, a block diagram of a data processing device for a tunnel boring machine according to the invention, which is equipped with an advancement planning unit, and FIG. 6 A side view in a very simplified representation of the exemplary embodiment of a tunnel boring machine according to the invention in accordance with FIG. 1 when cutting through a tunneling route in a geology with conditions changing in the advancing direction and tool replacement predication planes indicated.

FIG. 1 shows a side view in a simplified representation of an exemplary embodiment of a tunnel boring machine 103 according to the invention, which is equipped with a rotatable cutting wheel 106. A number of excavation tools 109 are mounted on the cutting wheel 106, wherein, in the case of this exemplary embodiment, every depicted excavation tool 109 is equipped with a cutting roller 121 for cutting through a tunnelling route 112 in upcoming geology 115 for the removal of material at a tunnel face 118 located in front of the cutting wheel 106 in the advancing direction.

Assigned to every excavation tool 109 according to the invention is a sensor unit 124, which is designed to detect, by means of a temperature detection module (not depicted in FIG. 1), the temperature and/or the status of the relevant excavation tool 109, for example the wear status and/or the rotational state of the cutting roller 121 of the excavation tool 109, in the form of associated excavation tool data. The sensor units 124 are connected, for example via a cable harness 127 and/or via a wireless signal path, to an excavation tool measured data storage 130, which comprises an excavation tool data storage area 133 for every sensor unit 124. The current status and expediently also the status history over a specific time period can be detected for the associated excavation tool 109 in every excavation tool data storage area 133.

Furthermore, the exemplary embodiment according to FIG. 1 is embodied with a rotational speed transmitter 136, with which a rotational speed applied to the cutting wheel 106 by a cutting wheel drive 139 via a cutting wheel gear 142 can be detected. The rotational speed transmitter 136 is connected via a cable connection 145 and/or via a wireless signal path to an advancement measured data storage 148, with which the current rotational speed and expediently also the rotational speed history can be detected over a specific time period.

In the exemplary embodiment according to FIG. 1, a torque transmitter 151 is furthermore provided, which is in an operative connection with the cutting wheel drive 139 and with which the torque that is applied to the cutting wheel 106 can be detected. The torque transmitter 151 is connected via a further cable connection 154 and/or via a wireless signal path to the advancement measured data storage 148, with which the current torque and expediently also the torque history can continue to be detected over a specific time period.

In addition, to detect data about the conditions in an excavation chamber 157, the exemplary embodiment according to FIG. 1 has an excavation chamber pressure transmitter 160 arranged in the excavation chamber 157, which is connected via a further cable connection 163 and/or via a wireless signal path to the advancement measured data storage 148, with which the current pressure and expediently also the pressure history can continue to be detected over a specific time period.

The excavation tool measured data storage 130 and the advancement measured data storage 148 are connected in a cable-less or cabled manner to a data processing device, which is not depicted in FIG. 1 and is explained further below.

Finally, for the sake of clarity, the simplified representation of an exemplary embodiment of a tunnel boring machine 103 according to the invention still shows pairs of advancing compactors 166, which are held in a compactor bearing ring 169 and which, when cutting through a tunnelling route 112, are supported on tubbing segments 172 provided to line a tunnel in order to press the cutting wheel 106 against the tunnel face 118.

Figure 2:
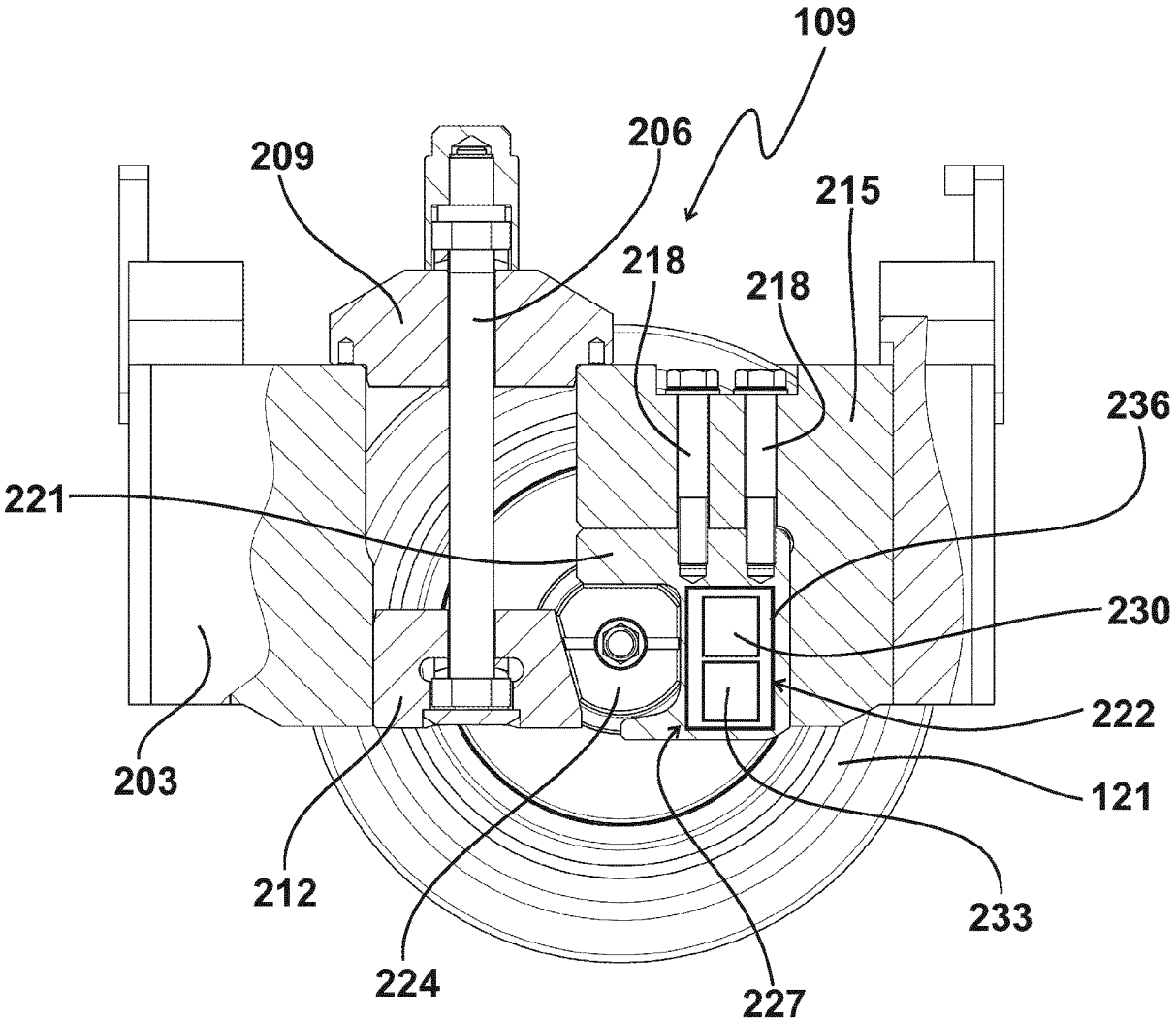

As an example, FIG. 2 shows a sectional view of an excavation tool 109 that is embodied with a cutting roller 121 for a tunnel boring machine 103 according to the invention. The excavation tool 109 is equipped with a cutting roller housing 203, by means of which a cutting roller axis 224 can be fixed so as to be secured against rotation at the end side via an arrangement on both sides of the cutting roller 121, which arrangement is made of a clamping part 212, which can be tensioned via a tensioning screw 206 that is supported on an abutment piece 209, and of a bearing block 215, which is connected via connecting screws 218 to a C-shaped embodied champing element 221, which is embodied with a sensor housing 222.

The sensor housing 222 assumes a design of a sensor unit 227, which is equipped in particular with a load sensor 230 and with a load transmitter 233 as components of a load detection module 236. The mechanical load acting on the cutting roller axis 224 can be detected with the load sensor 230 functioning for example via a mechanical deformation of a strain gauge or a strain measuring sleeve. The data recorded by the load sensor 230 can be supplied via the load transmitter 233 to the excavation tool measured data storage 130 in a cable-less manner or in an at least partially cabled manner.

Figure 3:
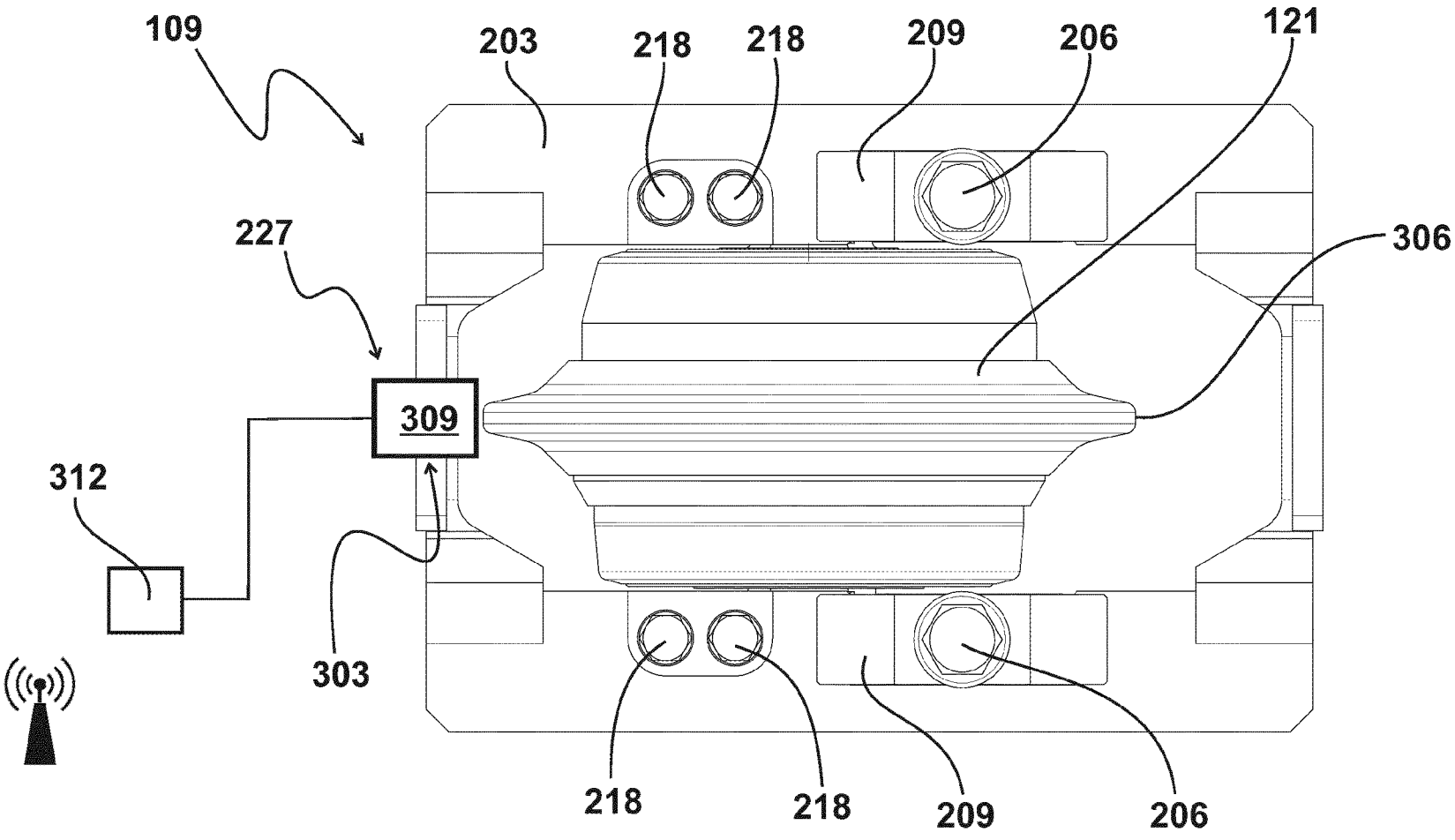

FIG. 3 shows a top view of the excavation tool 109 according to FIG. 2 with the sensor unit 227, which is embodied with a wear status detection module 303 in addition to or as an alternative to the load detection module 236. With the wear status detection module 303, the wear status of the cutting roller 121 can be detected, for example by measuring a distance to a cutting edge 306 of the cutting roller 121, as the most raised and therefore characteristic region for the degree of wear of the cutting roller 121, by means of a distance sensor 309, as a component of the wear status detection module 303, and can be supplied to the excavation tool measured data storage 130 via a distance transmitter 312, as a further component of the wear status detection module 303.

Figure 4:
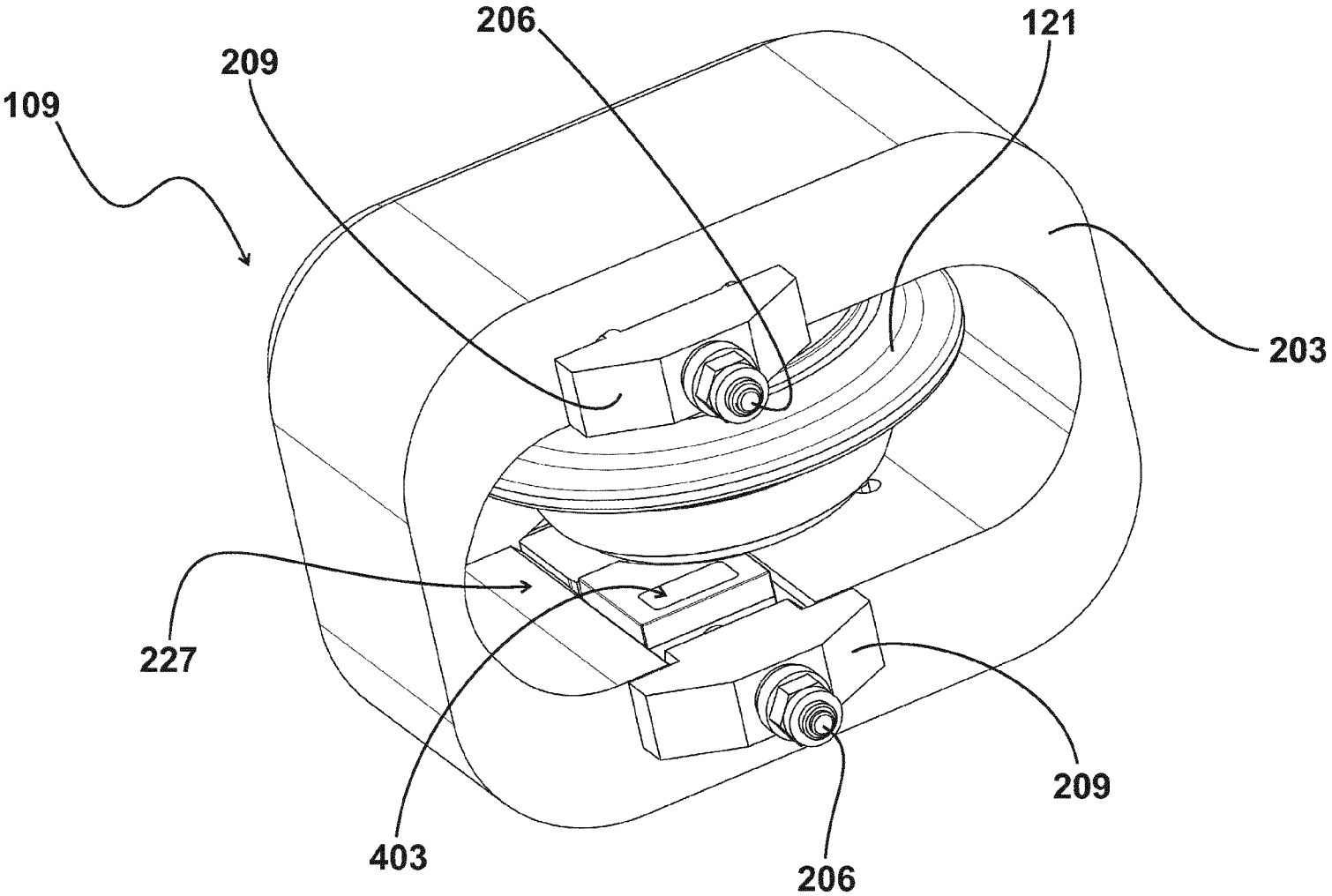

As an example, FIG. 4 shows a perspective view of an excavation tool 109 for a tunnel boring machine 103 according to the invention, which is equipped with a cutting roller 121 similar to the previously explained excavation tools 109 and in which the sensor unit 227 is embodied as a supplement or an alternative to a load detection module 236 and/or to a wear status detection module 303 with a rotational state detection module 403. With the rotational state detection module 403 functioning in a contactless manner in the case of this design, the rotational state of the cutting roller 121, in particular whether the cutting roller 121 is rotating at all, and, if so, at what rotational speed, can accordingly be detected and can be supplied to the excavation tool measured data storage 130 in a cable-less manner or in an at least partially cabled manner.

Figure 5:
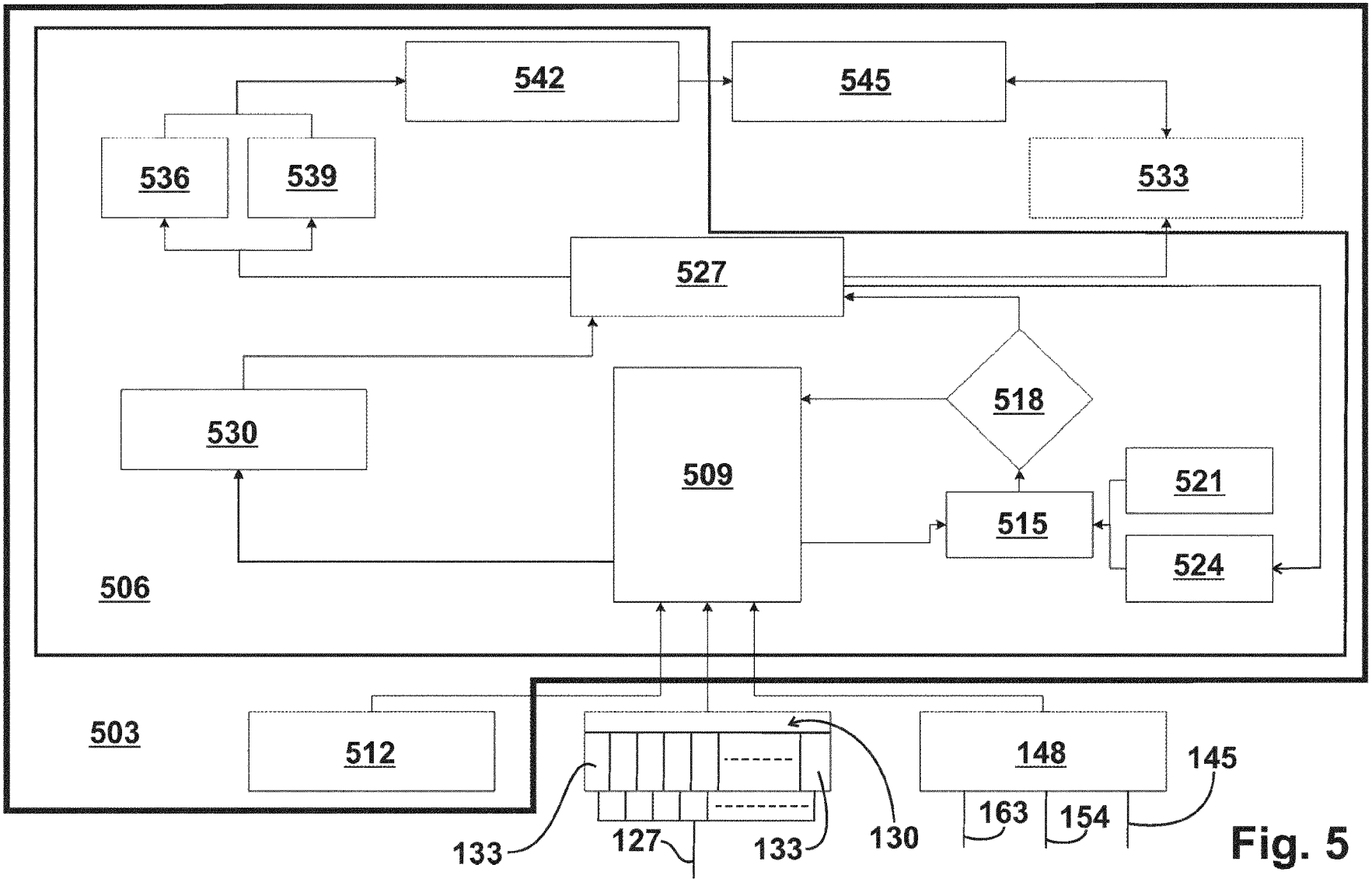

As an example, FIG. 5 shows a block diagram of an embodiment of a data processing device 503, which is equipped with an advancement planning unit 506, for a tunnel boring machine 103 according to the invention. Attached to a tool management central module 509 of the advancement planning unit 506 are, on the one hand, the excavation tool measured data storage 130 as well as the advancement measured data storage 148 and, on the other hand, a geospatial data storage 512.

In the tool management central module 509, it is possible to store, on the one hand, framework parameters for a current tunnelling, such as the diameter of the cutting wheel 106 along with characteristic data for the excavation tools 109, such as the type, condition upon installation and position after installation, and, on the other hand, the excavation tool data that are provided with a time stamp and imported from the excavation tool measured data storage 130 according to the type of so-called change protocols.

Included in the geospatial data storage 512 are geospatial data that are characteristic for a tunnelling route 112 to be cut through, which were obtained for example by a preliminary investigation of the geological analysis of bore cores, and in particular the type as well as the sequence of the anticipated geology located in front of the tunnel boring machine 103 in the advancing direction.

The tool management central module 509 is connected to a data processing module 515 and to a service life prediction module 518 as further components of the advancement planning unit 506, wherein the data processing module 515 and the service life prediction module 518 are also connected to each other. Attached to the data processing module 515 as further components of the advancement planning unit 506, are, on the one hand, an empirical value storage 521, in which empirical values from previous tunnellings in different geologies can be stored including the expected geology for a current tunnelling, and a correction parameter storage 524, in which correction parameter values to use for a current tunnelling can be stored.

In addition, the advancement planning unit 506 is equipped with a comparison module 527, which is connected, on the one hand, to the service life prediction module 518 and, on the other hand, to a maintenance plan storage 530 of the advancement planning unit 506, which is also connected expediently to the tool management central module 509 for updating at given points in time, such as especially when reaching tool replacement predication planes, to a warning/alarm generator 533 of the data processing device 503 and to a parallel arrangement of a change interval prediction module 536 as well as of a linear meter prediction module 539 of the advancement planning unit 506.

The parallel arrangement of the change interval prediction module 536 and the linear meter prediction module 539 is also connected to a change recommendation processing module 542 of the advancement planning unit 506, which is also connected to a need adjustment module 545 of the data processing device 503.

In the case of an advancement of the tunnel boring machine 103 according to the invention for cutting through a tunnelling route 112, the most important components of which were explained above as an example, the data processing device 503 operates essentially as explained in the following.

The data from the tool management central module 509, the empirical value storage 521 and the correction parameter storage 524 can be processed with the data processing module 515 in such a manner that the probable remaining service life of the excavation tools 109 can be determined with the service life prediction module 518 by very close-to-reality target data, as therefore very reliable quasi actual data, which is based on current excavation tool data and an assumed progression of the further phases of tunnelling, which data can be supplied to the comparison module 527.

With the comparison module 527, it is possible to compare the quasi actual data in accordance with the close-to-reality predetermination from the service life prediction module 518 with the target data associated with the tunnelling location in accordance with interpolation predictions between tool replacement predication planes from the maintenance plan storage 530 to the effect that, on the one hand, in the case of deviations that are not tolerable and that also cannot be rectified by correction measures of advancement parameters that are described in more detail further below, an immediate alarm can be output via the warning/alarm generator 533 and, on the other hand, in the case of still tolerable deviations, correction data that can be supplied to the correction parameter storage 524 can be generated in an automated self-learning mode, with which correction data, new quasi actual data can be generated with the service life prediction module 518 via the correction parameter storage 524 and the data processing module 515, which data produce a smaller deviation of the quasi actual data from the target data.

With the change interval prediction module 536 and the linear meter prediction module 539, and based on initial data of the comparison module 527, recommendations for planning change intervals for a position change at a new excavation tool position or for replacement of excavation tools 109 with new excavation tools 109 at specific projected linear meters can be made and can be supplied to the change recommendation processing module 542, with which concrete instructions for work to be performed at at least the next tool replacement predication plane can be generated and displayed.

In addition, recommendation data can be generated with the change interval prediction module 536 to the effect that advancement parameters of the tunnel boring machine 103 such as the rotational speed of the cutting wheel 106 and/or torque being applied to the cutting wheel 106 are adjusted to the effect that in particular even in the case of conditions in the geology to be broken through that deviate from the geospatial data, at least the next tool replacement predication plane is reached preferably with excavation tools 109 that are in a sense optimally worn, that, at the next tool replacement predication plane, excavation tools 109 are replaced based on full wear and excavation tools 109 that are not yet fully worn are installed at respectively new excavation tool positions in such a way, that, after such position changes, only partially worn excavation tools 109 reach at least the tool replacement predication plane after the next one by [the time of] full wear.

Because the change recommendation processing module 542 is connected to the need adjustment module 545, it is also possible to estimate the probable future need for excavation tools 109 at tool replacement predication planes and, when the inventory of available new excavation tools 109 for replacing fully worn excavation tools 109 falls short, a warning message is triggered by the warning/alarm generator 533 to increase the inventory of new excavation tools 109 by the next tool replacement predication plane.

When reaching tool replacement predication planes, it is expedient to update the maintenance plan storage 530 via the tool management central module 509 to the effect that, after changing and/or replacing excavation tools 109, the then current equipping of the cutting wheel 106 with excavation tools 109 in the respective status at the corresponding excavation tool positions can be stored in the maintenance plan storage 530.

Figure 6:
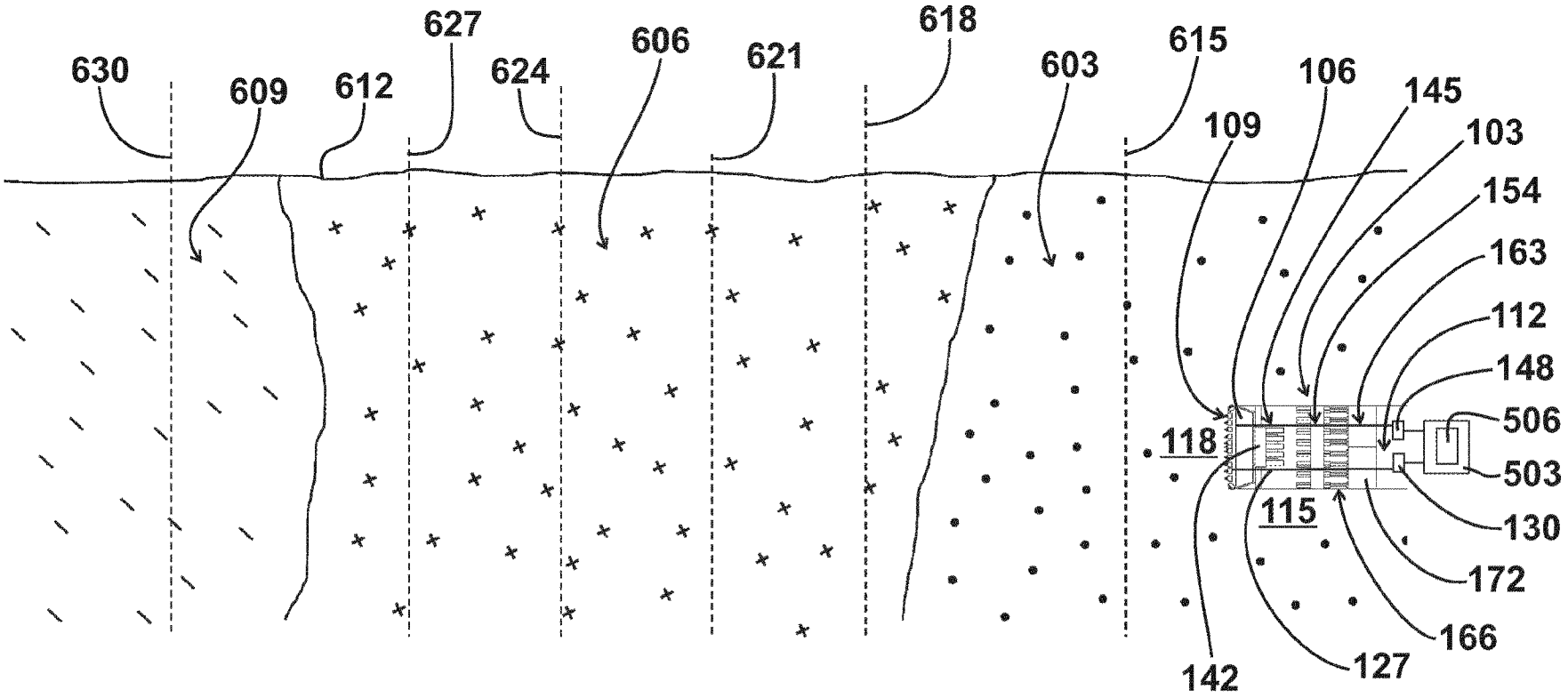

FIG. 6 shows a side view in a very simplified representation of the exemplary embodiment of a tunnel boring machine 103 according to the invention in accordance with FIG. 1 when cutting through a tunnelling route 112 beneath a surface of the earth in upcoming geology 115 with conditions changing in the advancing direction, symbolically depicted by advancement sections 603, 606, 609 filled with various symbols and with vertically aligned tool replacement predication planes 615, 618, 621, 624, 627, 630 indicated by dashed lines, as they were predetermined by the advancement planning unit 506 for the status of the advancement in the depiction according to FIG. 6.

In the depiction in accordance with FIG. 6, it is evident that the tool replacement predication planes 615, 618, 621, 624, 627, 630 are spaced apart differently in advancement sections 603, 606, 609, which have different hardnesses in terms of the geology, so that, according to the invention, as explained in more detail further above, the points in time for a change and/or replacement of excavation tools 109 can be planned relatively accurately. As a result, the efficiency of the advancement is increased considerably as compared to estimates based on empirical values.

The invention claimed is:

1. A method for tunneling, comprising:

providing a tunnel boring machine including:

a rotatable cutting wheel including a plurality of excavation tools mounted at respective excavation tool positions on the cutting wheel, and a plurality of sensor units operably coupled to respective excavation tools, each sensor unit outputting excavation tool data including at least a status of the respective excavation tool and an excavation tool position on the cutting wheel, storing each of geospatial data, the excavation tool data, and advancement data;

determining one or more tool replacement prediction planes based upon the geospatial data, the excavation tool data, and the advancement data, the one or more tool replacement prediction planes indicating a position of the tunnel boring machine along a tunneling path where one or more of the plurality of excavation tools is predicted to be i) replaced with a new excavation tool, or ii) repositioned to a new position on the rotatable cutting wheel, and predetermining, when the tunnel boring machine is at a position at, or prior to, a next tool replacement prediction plane along the tunneling path, that one or more of the plurality of excavation tools is to be:

i) replaced, when one of the plurality of excavation tools is nonfunctional in any excavation tool position on the rotatable cutting wheel while the tunnel boring machine is located prior to the next tool replacement prediction plane, or ii) repositioned from a present excavation tool position to a new excavation tool position, when one of the plurality of excavation tools is:

a) nonfunctional in the present excavation tool position on the rotatable cutting wheel while the tunnel boring machine is located prior to the next tool replacement prediction plane, but b) is functional in the new excavation tool position at least until the tunnel boring machine is located at a tool prediction plane after the next tool replacement prediction plane.

2. The method of claim 1, wherein one or more of the plurality of excavation tools is replaced at a tool replacement predication plane when worn.

3. The method of claim 1, wherein at least one sensor unit of the plurality further comprises a wear status detection module, the wear status detection module detecting a wear status of the respective excavation tool operably coupled to the sensor unit.

4. The method of claim 1, wherein at least one sensor unit of the plurality further comprises a temperature detection module, the temperature detection module detecting a temperature of the respective excavation tool operably coupled to the sensor unit.

5. The method of claim 1, wherein at least one sensor unit of the plurality further comprises a load detection module, the load detection module detecting a mechanical load exerted on the respective excavation tool operably coupled to the sensor unit.

6. The method of claim 1, wherein:

at least one of the plurality of the excavation tools include at least one rotatable cutting rollers, and at least one sensor unit of the plurality further comprises a rotational state detection module, the rotational state detection module detecting a rotational state of at least one of the rotatable cutting rollers operably coupled to the sensor unit.

7. The method of claim 1, wherein:

the tunnel boring machine further comprising a rotational speed transmitter, the rotational speed transmitter detecting a rotational speed of the cutting wheel, and the predetermining of the replacing and/or repositioning of one or more of the plurality of excavation tools is based upon the detected rotational speed of the cutting wheel.

8. The method of claim 1, wherein:

The tunnel boring machine further comprising a torque transmitter, the torque transmitter detecting a torque applied to the cutting wheel, and the predetermining of the replacing and/or repositioning of one or more of the plurality of excavation tools is based upon the detected torque applied to the cutting wheel.

9. The method of claim 1, wherein the excavation tool data includes wear data associated the wear of one or more other excavation tools during one or more previous tunneling in one or more different geologies, and the predetermining of the replacing and/or repositioning of one or more of the plurality of excavation tools is based upon the wear data.

10. The method of claim 1, wherein:

the determining of the one or more tool replacement prediction planes is further based upon:

quasi-actual status data, the quasi-actual status data based upon a calculated predetermination of wear of excavation tools based upon the wear of one or more other excavation tools during one or more previous tunneling in one or more different geologies, and target status data based upon an interpolation between two or more of the tool replacement predication planes, and the predetermining of the replacing and/or repositioning of one or more of the plurality of excavation tools is based upon a correction parameter, the correction parameter based upon a comparison of the quasi-actual status data with the target status data.

11. The method of claim 1, further comprising:

generating a warning message and an alarm message based upon a determined critical and intolerable operating statuses and/or wear statuses associated with one or more of the plurality of excavation tools, the warning message and alarm message generated prior to the tunnel boring machine being located at the next tool replacement prediction plane.

12. The method of claim 1, further comprising determining a need for one or more new excavation tools for replacing the one or more excavation tools of the plurality predetermined to be replaced, the need based upon the tunnel boring machine reaching at least the next tool replacement predication plan.

* * * * *